United States Patent [19]

Yother

[11] 4,117,633

[45] Oct. 3, 1978

[54] HONING PLATE

[76] Inventor: Cecil L. Yother, 1932 Vining St., San Leandro, Calif. 94579

[21] Appl. No.: 832,574

[22] Filed: Sep. 12, 1977

[51] Int. Cl.[2] ..... B24B 41/00

[52] U.S. Cl. ..... 51/262 R; 51/324

[58] Field of Search ..... 51/245, 262 R; 29/404, 29/DIG. 26, DIG. 19

[56] References Cited

U.S. PATENT DOCUMENTS

| | | | |
|---|---|---|---|
| 2,006,158 | 6/1935 | Connor | 51/245 |
| 2,006,159 | 6/1935 | Connor | 51/245 |
| 2,266,113 | 12/1941 | Wiss | 51/245 |

*Primary Examiner*—Harold D. Whitehead
*Assistant Examiner*—Roscoe V. Parker
*Attorney, Agent, or Firm*—Bruce & McCoy

[57] ABSTRACT

An improved honing plate for imposing operational stress on an internal combustion engine block during re-boring and honing of the cylinder walls.

5 Claims, 4 Drawing Figures

HONING PLATE

BACKGROUND OF THE INVENTION

1. Field of the Invention

The present invention relates to internal combustion engine repair equipment and more particularly to automobile engine honing plates for use during machining of the engine block.

2. Description of the Prior Art

Honing plates have been utilized for the same purpose as the present invention but have been comprised of flat plates of uniform thickness. They produce a stressing and distortion of an engine block which does not accurately simulate the normal operating stress and distortion of an engine caused by the bolt-on components such as cylinder heads and intake manifolds. The more accurately a honing plate can simulate the natural operating stress and the distortion of the engine, the more accurately will the rebored and honed cylinder walls approximate their ideal shape within the assembled engine. The prior art therefore fails to simulate the stress and distortion required to produce high quality performance engines after honing and re-boring of the cylinder walls.

SUMMARY OF THE INVENTION

The present invention is an improvement in a honing plate which is bolted to an engine block during re-boring and honing of the cylinder walls within the engine block to stress and distort the block to simulate its natural operating conditions. It comprises a solid metal plate having a flat surface which is formed to mate with the surface of the engine block in the position where the cylinder head is normally affixed thereto. The plate has formed therein a first set of holes to accommodate the cylinder head bolt studs and a second set of larger holes formed therein and disposed concentric with, and slightly larger than, the cylinder bores in the engine block when the plate is mounted thereon. The plate is of varying thickness whereby it imposes forces on the engine block when it is bolted thereto, and the intake manifold is bolted to it, which create the normal stress and distortion that occur within the engine when the bolt-on equipment is secured in operative position thereon.

The present invention is an improvement over the constant thickness honing plates of the prior art in that it is formed with a varying thickness and means to permit the attachment of the operative intake manifold thereto. The forces which create the operating stress and distortion within an engine are determined by the metal mass and thickness of the attached cylinder head. The areas of greatest thickness of the present invention are therefore disposed to correspond to the areas of the cylinder head which have the greatest metal mass and thickness. Because the present invention is also structured to allow for attachment of the intake manifold to the honing plate, an overall stress and distortion which closely approximates the natural operating stress and distortion within the engine is created.

OBJECTS OF THE INVENTION

It is an important object of the present invention to provide an improved honing plate for re-boring and honing the cylinder walls within an internal combustion engine block.

It is another object of the present invention to provide an improved solid metal honing plate which has a varying thickness which corresponds to the metal mass of the engine cylinder head.

It is a further object of the present invention to provide a honing plate which effects stress and distortion of an engine block that closely approximates the normal operating stress and distortion imposed upon said engine block by the bolt-on components thereof.

And it is yet another object of the present invention to provide a honing plate which allows for attachment of the intake manifold thereto such that the stress and distortion created thereby will closely approximates the stress and distortion imposed upon the operating engine.

Other objects of the invention will become apparent when this description is considered in conjunction with the accompanying drawings.

DESCRIPTION OF THE PREFERRED EMBODIMENT

Figure 1:
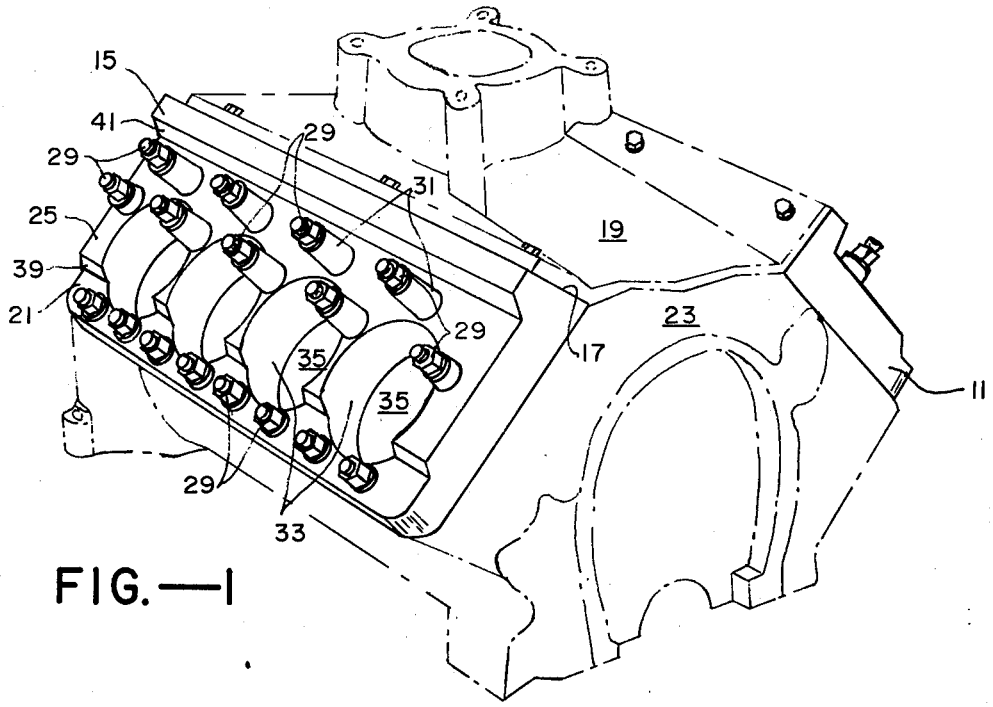
FIG. 1 is a perspective view of an engine block with the honing plates of the present invention attached thereto.
Figure 2:
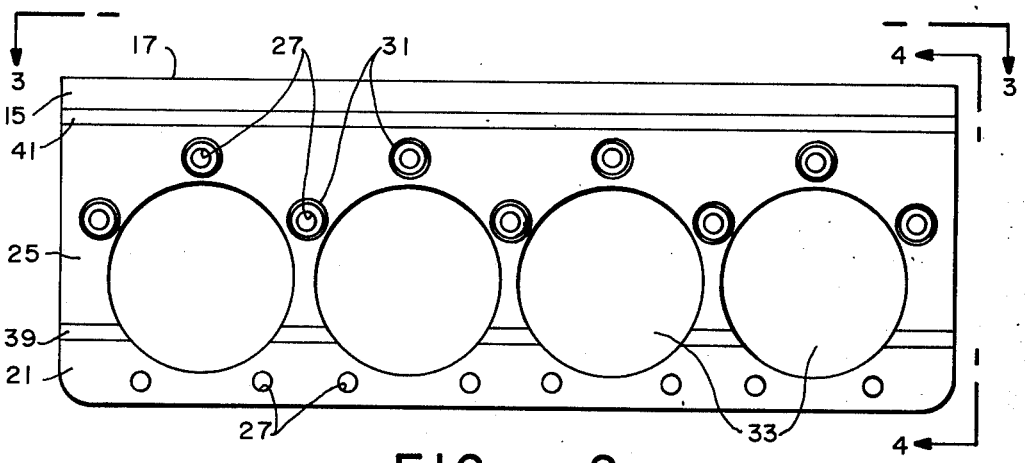
FIG. 2 is a top plan view of a honing plate of the present invention.
Figure 3:
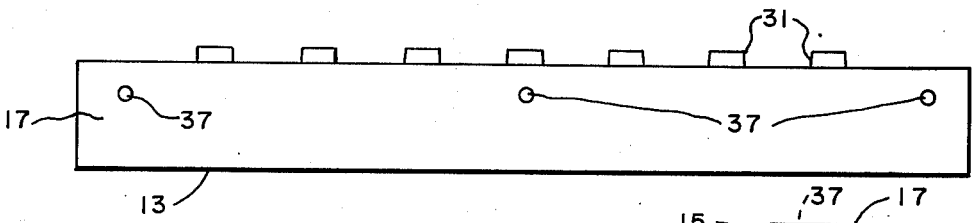
FIG. 3 is a side elevational view thereof.

The present invention is an improvement in honing plates which are bolted to an engine block during re-boring and honing of the cylinder walls within the engine block. The honing plate stresses and distorts the engine block, and permits the attachment of the intake manifold thereto, to simulate the natural operating condition that exists in the engine block when all of the bolt-on equipment is secured thereto. The invention consists of a solid metal plate 11 having a flat surface 13 which is formed to mate with the cylinder head attachment surface of the engine block 23.

Disposed within the plate are a first series of holes 27, hereinafter termed cylinder head bolt/stud holes, formed to correspond to the location of the cylinder head bolt/studs 29 as arranged on said engine block. These first holes allow the cylinder head bolt/studs to penetrate through said plate and are the means by which the plate is secured to the engine block during re-boring and honing of the cylinder walls. For securing the cylinder heads to the engine block, the block can have cylinder head bolt studs that are fixed to the engine block and protrude from it or head bolts which screw into the block. The cylinder head bolt studs have threaded ends and they penetrate through holes in the cylinder head. A threaded nut is then screwed onto the end of the cylinder head stud to clamp down upon the cylinder head and secure it to the engine block. On engines which use head bolts, the blocks are made with threaded holes therein. On assembly, the head bolts penetrate through the cylinder head and screw into the threaded holes in the engine block to secure the cylinder head thereto. The present invention is equally suited for either type of engine block and the first series of holes 27 will correspond to the location of the studs or holes of the block.

Metal protrusions 31 are formed on the plate surrounding some of the cylinder head bolt/stud holes 27 wherever the actual cylinder head is thicker than the plate. The protrusions permit the cylinder head stud nuts, or the head bolts, whose length is dictated by the thickness of the cylinder head, to seat against the protrusions on the plate for clamping the honing plate to the block.

Formed within the plate are a second series of larger holes 33, hereinafter termed the plate cylinder holes, which are formed to be disposed concentric with and slightly larger, than the cylinder bores 35 within the engine block when the plate is mounted thereon. The plate cylinder holes must be formed larger than the cylinder bores to allow the honing and re-boring tools to penetrate through the plate without interference and to machine the cylinder walls.

The thickness of the plate is varied across the width of the plate with a uniform thickness along the length thereof. The thicker areas of the plate correspond to those areas of the cylinder head that have the greatest metal mass and thickness, and the thinner areas of the plate correspond to those areas of the cylinder head that have the least metal mass and thickness.

Figure 4:
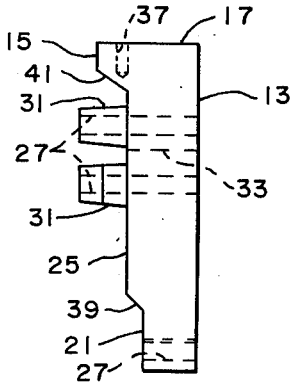
FIG. 4 is an end elevational view thereof.

In the preferred embodiment, the thickness is varied in three levels. The thickest level 15 of the plate is disposed along the edge 17 of the plate which engages with the intake manifold 19. The thinnest level 21 of the plate is disposed at the edge of the plate which is furthest removed from the intake manifold. The intermediate thickness level 25 is formed between the two opposite edge levels of thickness. It is possible to make a honing plate which serves the purpose nearly as well as the present invention with a continuously tapered top surface that tapers from the thickest part 15 (FIG. 4) in a straight surface to the thinnest part 21. The three level thickness plate is believed to more accurately simulate the cylinder heads.

A first transition section 39 is formed on the plate at the junction of the thinnest level of thickness 21 and the intermediate level of thickness 25. This transition section is slanted to give greater strength to the plate. In the preferred embodiment, this transition section is disposed in such a position that it intersects the plate cylinder holes 33 at a point on the lower half of the plate cylinder holes.

A second transition section 41 is formed in the plate at the junction of the intermediate level of thickness 25 and the thickest level of thickness 15. This transition section is also slanted to give greater strength to the plate. In the preferred embodiment this second transition section is disposed such that it is formed between the metal protrusions 31 surrounding the cylinder head bolt stud holes 27 and the edge 17 of the plate to which the intake manifold is attached. The thickness of the honing plate is designed partially to approximate the metal mass in the particular cylinder head and partially to approximate the strength and thickness of the cylinder head. This design imposes the same forces on the engine block when the honing plates are secured thereto, with the intake manifold secured to the honing plates, as occurs when the actual cylinder heads and intake manifold are secured to the block.

Disposed within the plate are a third series of holes 37, hereinafter termed intake manifold attachment holes, which are formed in the edge of the plate at the thickest level. Alternatively, studs could be inserted into the intake manifold attachment holes.

It will be seen from the foregoing description that the invention will achieve the objects attributable thereto and while it has been described in considerable detail, it is not to be limited to such details except as may be necessitated by appended claims.

What I claim is:

1. An improvement in a honing plate which is bolted to an engine block during re-boring and honing of the cylinder walls within said engine block to stress and distort said engine block to simulate its natural operating condition, comprising a solid metal plate having a flat surface which is formed to mate with the surface of said engine block in the position where the cylinder head is normally affixed to said engine block, said plate having formed therein a first set of holes to accommodate the cylinder head bolt studs and a second set of larger holes formed therein being disposed concentric with and slightly larger than the cylinder bores in said engine block when said plate is mounted thereon, and said plate having a varied thickness and means for attachment of the engine intake manifold thereto, whereby said plate imposes forces on said engine block which cause the normal stress and distortion to occur within said engine block as when the cylinder heads and intake manifold are secured in operative position thereon.

2. The honing plate of claim 1, wherein the thickness of said plate is thicker in the areas which correspond to areas of the cylinder head which have the greatest metal mass and thickness and is thinner in the areas which correspond to areas of the cylinder head which have the least metal mass and thickness.

3. The honing plate of claim 1, wherein said plate has three levels of thickness with the thickest level being formed towards the plate edge which is disposed closest to said intake manifold and the thinnest level is formed at the plate edge furthest removed from said intake manifold and the intermediate thickness level is disposed between the outer two levels.

4. The honing plate of claim 1 including metal protrusions formed around at least some of said first set of holes and corresponding to the actual thickness of said cylinder head at those locations to permit stud nuts or the cylinder head bolts to seat thereagainst.

5. An improvement in a honing plate which is bolted to an engine block during re-boring and honing of the cylinder walls within said engine block to stress and distort said engine block to simulate its natural operating condition, comprising a solid metal plate having a flat surface which is formed to mate with the surface of said engine block in the position where the cylinder head is normally affixed to said engine block, said plate having formed therein a first set of holes to accommodate the cylinder head bolt studs and a second set of larger holes formed therein being disposed concentric with and slightly larger than the cylinder bores in said engine block when said plate is mounted thereon, said plate having three levels of thickness with the thickest level being formed towards the plate edge which is disposed closest to said intake manifold and the thinnest level being formed at the plate edge furthest removed from said intake manifold, and the intermediate thickness level being disposed between the outer two levels, and metal protrusions formed around at least some of said first set of holes and corresponding to the actual thickness of said cylinder head at those locations to permit stud nuts or the cylinder head bolts to seat thereagainst, a first transition section being formed at the junction of said thinnest level of thickness and said intermediate level of thickness and being slanted to provide greater strength to the plate, a second transition section being formed at the junction of said intermediate level of thickness and said thickest level of thickness and being slanted to provide greater strength to the plate, and means for attachment of the engine intake manifold to said plate at the thickest level thereof, said means including threaded holes or studs which are positioned in said plate at positions to mate with the holes in said intake manifold by which it is normally attached to the cylinder head.

* * * * *